United States Patent [19]

Gimber et al.

[11] Patent Number: 4,747,979

[45] Date of Patent: May 31, 1988

[54] REMOVAL OF TOXINS FROM COTTONSEED

[75] Inventors: Gerald A. Gimber; Elliot M. Haschke, both of Lake Jackson, Tex.

[73] Assignee: The Dow Chemical Company, Midland, Mich.

[21] Appl. No.: 701,846

[22] Filed: Feb. 14, 1985

Related U.S. Application Data

[63] Continuation-in-part of Ser. No. 627,014, Jul. 2, 1984, abandoned.

[51] Int. Cl.[4] ..... C11B 1/00

[52] U.S. Cl. ..... 260/412.4; 426/430; 426/630

[58] Field of Search ..... 426/430, 630; 260/412.4

[56] References Cited

U.S. PATENT DOCUMENTS

| | | | |
|---|---|---|---|
| 1,260,656 | 3/1918 | Bollmann | 426/430 |
| 1,653,201 | 12/1927 | Bollmann | 260/412.4 |
| 2,475,419 | 7/1949 | Battistella | 260/412.4 |
| 2,484,831 | 10/1949 | Hutchins et al. | 260/412.4 |
| 2,680,754 | 6/1954 | Stapelberg | 260/412.8 |
| 3,721,569 | 3/1973 | Steinkraus | 260/412.4 |
| 4,008,210 | 2/1977 | Steele et al. | 426/430 |
| 4,062,984 | 12/1977 | Lindquist | 426/430 |
| 4,279,811 | 7/1981 | Gray et al. | 426/430 |
| 4,460,504 | 7/1984 | Rubin et al. | 260/412.4 |

OTHER PUBLICATIONS

Fore et al, "J. Am. Oil Chemists Soc.", vol. 47, No. 1, pp. 17–18, (1969), Reprint.

Vix et al, "Chem. Eng. Progress Symp. Series", vol. 65, No. 93 (1969) pp. 49–56 (Reprint).

*Primary Examiner*—J. E. Evans

*Attorney, Agent, or Firm*—Glwynn R. Baker; A. Cooper Ancona

[57] ABSTRACT

A method is disclosed for removal of toxins and oil from cottonseed by contact of the toxin/oil containing cottonseed with a chlorinated hydrocarbon solvent and a protic or aprotic solvent. Batch, semicontinuous and continuous methods of contacting are also described.

12 Claims, No Drawings

REMOVAL OF TOXINS FROM COTTONSEED

CROSS REFERENCE TO THE RELATED APPLICATION

This application is a continuation-in-part of application Ser. No. 627,014 filed July 2, 1984, now abandoned.

BACKGROUND OF THE INVENTION

Various solvents have been employed to extract oil from cottonseed meal. Hexane is the most extensively used solvent in the cottonseed processing industry. While cottonseed oil is very soluble in hexane, the toxic components such as aflatoxin and gossypol are not, and thus much of this toxic material remains in the extracted meal following hexane extraction, lowering the value of the meal. The gossypol is in the form of free gossypol, which is toxic, and bound gossypol, in combination with lysine, which is not toxic but decreases the protein content of the meal. The aflatoxin remaining with the meal is a toxic residue which reduces the value of the meal It would be useful to have a process which simultaneously removes oil, aflatoxin and gossypol resulting in an increase in the value of extracted cottonseed meal.

BRIEF DESCRIPTION OF THE INVENTION

In accordance with the present invention the meal, (flake, ground meal or expanded) obtained from cottonseed is contacted with a solvent mixture composed of a chlorinated hydrocarbon solvent and either an aprotic or protic solvent. The treatment is carried out in a batchwise, semi-continuous or continuous manner, at ambient temperature or an elevated temperature up to the boiling point of the solvents. The contacting maybe carried out by contacting the solvent with the meal batchwise or in counter current percolation flow through a bed, deep or shallow with or without mild agitation, e.g. mechanical, ultrasonic or the like. It is of course understood that the solvent mixture may be vaporized and passed through a mass or body of flake or meal condensing onto the meal dissolving the toxins into the condensate. The method of contacting is not critical so long as the meal is essentially contacted with a sufficient amount of solvent to maintain the solvent substantially below its saturation point, with respect to the toxins and oil, in the final contact.

The toxins (e.g. gossypol and aflatoxin) in the solvent/oil solution can be removed by conventional refining, which are well understood process steps.

Solvents which have been satisfactorily employed in combination to extract the toxins and oil are those chlorinated hydrocarbon solvents having from one to two carbon atoms and, of course, at least one chlorine atom. Exemplary of such solvents are methyl chloride ($CH_3Cl$), methylene chloride ($CH_2Cl_2$), chloroform ($CHCl_3$), carbon tetrachloride ($CCl_4$), 1,1,1-trichloroethane ($C_2H_3Cl_3$), 1,1,2-trichloroethylene ($CH_2CHCl$), perchloroethylene ($CCl_2CCl_2$). It is to be understood that methylene chloride, and 1,1,1-trichloroethane are the preferred solvents as they are more suitable for use in removing gossypol from cotton meal which is to be used as a nutrient product. Methyl chloride, chloroform, trichloroethylene, and carbon tetrachloride each dissolve gossypol and aflatoxin but are not suitable for use in treating any product which has the possibility of use as a food because of physical properties; protein interaction with the solvent forming toxic or suspect toxic properties leading to public uncertainty that all of the solvent and these protein interaction products can be removed.

Suitable aprotic and/or protic solvents are the lower $C_1$ to $C_4$ alcohols (methyl, ethyl, propyl, isopropyl, butyl, isobutyl, secondary butyl, and tertiary butyl alcohols), alkyl ethers, ketones, as well as dimethyl formamide, dimethyl sulfoxide and the like. Again, because of public sentiment lower alcohols are preferred. However, dimethyl formamide (DMF) and dimethyl sulfoxide (DMSO) are the most efficient solvents in combination with methylene chloride.

Commercial cotton seed extraction processes include the conditioning of the raw cottonseed material (often referred to in the trade as meats) with moisture prior to flaking, a procedure whereby the meats are compressed into a flake-like body. The conditioning is required to give the flakes a modicum of integrity during further processing. Thus, any commercially acceptable extraction process practiced in an economically viable manner will subject the solvent to the presence of water in the flake. The following description of the present invention contemplates the presence of water and its pick-up by the solvent from the flake. In the later examples data is presented in which the solvent is saturated with water prior to use to simulate the condition in a commercial operation where the solvent becomes saturated by repeated contact with the water wet flake or by steam distillation of the solvent from the product and or meal. Some of the protic solvents such as ethanol contain dissolved water, e.g. 5% in the case of ethanol, but when in combination with the chlorinated hydrocarbon solvent the system will still pick-up some additional water. Thus, applicants have found that chlorinated solvent/alcohol solutions, particularily ethanol containing 5% water, can pick up and hold water an excess of the amount initially present in the ethanol. The amount of extra (dissolved) water picked up increases as the amount of alcohol in the solvent is increased. However, addition of water in excess of saturation point of the chlorinated solvent/ co-solvent may reduce the effectiveness of the solvent system, due to the presence of free water. When free water is present, it adheres to the flakes forming a somewhat impermeable cake, which reduces solvent penetration resulting in decreased extraction efficiencies. Thus, the presence of water in the extraction process, so long as it is not free water, is not detrimental and is especially advantageous with some of the combinations herein disclosed.

The proportions of the two classes of solvents used in accordance with the present invention are not critical but for economic and time efficiency from about 0.5 to about 20 percent by weight of the aprotic or protic solvent is generally preferred.

DETAILED DESCRIPTION OF THE INVENTION

EXAMPLE 1

Cottonseed meal containing approximately 0.8% free gossypol was extracted in a soxhlet extractor to remove free gossypol. The solvents used were:

1. $MeCl_2$(100%)
2. $MeCl_2$+MeOH (6% Vol.)
3. $MeCl_2$+Acetone (10% Vol.)

*$MeCl_2$=methylene chloride; MeOH=methyl alcohol

The cottonseed meal was placed in a thimble and installed in the soxhlet apparatus. Low heat was applied which allowed a slow thimble immersion cycle rate, simulating the percolation process commonly used in the industry. Extracted meal was dried and analyzed for residual free gossypol.

Results are as follows:

| Solvent | Residual Free Gossypol (% Wt.) Cycles 3 | Total Time (min) | Cycles 5 | Total Time (min) | Cycles 10 | Total Time (min) |
|---|---|---|---|---|---|---|
| $MeCl_2$ | 0.21 | 70 | 0.12 | 105 | 0.083 | 210 |
| $MeCl_2$/6% MeOH | 0.096 | 70 | 0.063 | 105 | 0.041 | 210 |
| $MeCl_2$/10% Acetone | 0.20 | 70 | 0.15 | 105 | 0.063 | 210 |

EXAMPLE 2

Cottonseed meal was extracted with various solvent blends for oil and gossypol removal. This method employed agitating the samples on a wrist action shaker for extraction. The blends used were:

1. 7% MeOH in $MeCl_2$
2. 5% EtOH* in $MeCl_2$
3. 10% Ethyl ether in $MeCl_2$
4. 10% DMF in $MeCl_2$
5. 14% DMSO in $MeCl_2$
6. $MeCl_2$(control)

*EtOH=95% ethanol 5% water

Flaked cottonseed meal containing 0.8% free gossypol was placed in an 8 oz. bottle, covered with solvent, and secured to a wrist action shaker for 15 minutes of agitation. The miscella was poured off, fresh solvent added and the process repeated. A total of four 15 minute extractions were performed on each sample. The samples were desolventized in an oven at 60° C. for one hour then analyzed for free gossypol.

Data is as follows:

| Solvent | Free Gossypol (Wt. %) |
|---|---|
| MeOH/$MeCl_2$ | 0.051 |
| EtOH/$MeCl_2$ | 0.058 |
| Ethyl ether/$MeCl_2$ | 0.140 |
| DMF/$MeCl_2$ | 0.0236 |
| DMSO/$MeCl_2$ | 0.0123 |
| $MeCl_2$ | 0.135 |

Industrial application of the present invention can conveniently be carried out by contacting in a moving or fixed bed of cottonseed (flakes, expanded or ground material) with a countercurrent flow of the solvent blend in an apparatus whereby the material is in contact with the solvent blend for from 5 to 600 minutes, preferably about 60 minutes. Batchwise operations can be employed with equal success, that is a quantity of the solvent is circulated through the bed until its toxin content is equal to or near the solvent's saturation point. Optional extraction techniques such as ultrasonic assisted extractions, mixing, etc. will also work. A preferred extraction technique is the conventional percolation technique or percolation like technique now used for hexane extraction wherein initial aliquots of flakes are contacted with oil rich solvent, and such so contacted flake aliquot is successively contacted with successively less oil rich solvent, the final contact being with oil free solvent. The solvent can be recovered by distillation techniques and reused. The recovery may be carried out simultaneously with the contacting in adjacent conventional distillation equipment, or periodically, depending upon the nature of the operation.

The process of course can be conveniently carried out in any of the myriad of equipment conventionally employed by the industry and the solvent recovered in stills and reused.

The toxins may be isolated from the oil/solvent solution for purification or removed via conventional refining for disposal.

EXAMPLE 3

A comparison of oil extraction from cottonseed meal employing either hexane or $MeCl_2$ was performed using a 6"×6"×69" column simulating a deep bed counter current percolation extractor. The extraction was performed in a semi-countercurrent fashion, with fresh flakes in the bed being percolated with consecutive miscella (oil & solvent) solutions of decreasing oil content, followed by a rinse with fresh solvent. Miscella solutions were prepared by adding cottonseed oil to the solvent, to create desired miscella oil concentration. In the extraction sequence, the entire miscella solution of a given stage was allowed to percolate down through the bed of flakes, with miscella exiting the bottom recycled back to the head of the column for 10 minutes of additional percolation. This miscella was then stored in a separate container. Then the next miscella of the series (lower oil content) was contracted with the same bed of flakes in an identical manner, and so on, with the final percolation solvent being initially oil free.

In the $MeCl_2$ extraction, fresh flakes were first percolated with miscella ($MeCl_2$+oil) containing 6.8% oil, followed by successive miscellas of 3.3% oil and 1.0% oil, and a clean $MeCl_2$ final percolation, simulating a four stage countercurrent extraction. Solvent to flake ratio (wt) was held at 2:1 for each percolation stage.

The hexane extraction consisted of 5 stages, with initial miscella oil concentration of 10, 7, 5, 3.0 and 0.0% oil in hexane, respectively, performed in a manner identical to the $MeCl_2$ extraction. The solvent to flake ratio (wt) for the hexane extraction was 1.1 to 1, due to the lower density of hexane. Results are as follows.

| | Initial Oil in Flakes (% wt) | Residual Oil in Meal (% wt) |
|---|---|---|
| $MeCl_2$ | 29.8 | 1.17 |
| Hexane | 29.8 | 1.57 |

EXAMPLE 4

Flaked cottonseed meal was soaked in fresh solvent in a 125 ml separatory funnel, with the solvent solution drained off through the stopcock. Eight successive 15 minute soak periods were performed with each solvent blend on its respective flake sample. Extracted meal samples were desolventized to a bulk temperature of 80° C. in a vacuum oven, over a 45 minute period. Results are presented on an as-is basis.

| Extracted Meal Toxin Residuals | | |
|---|---|---|
| Feed Analysis Solvent | Aflatoxins ($B_1$ + $B_2$, ppb) | Free Gossypol % |
| Feed Analysis | 194 | .426 |
| $MeCl_2$ | 140 | .048 |
| $MeCl_2$ + .5% EtOH[1] | 123 | .043 |

-continued

Extracted Meal Toxin Residuals

| Feed Analysis Solvent | Aflatoxins ($B_1 + B_2$, ppb) | Free Gossypol % |
|---|---|---|
| $MeCl_2$ + 2.1% EtOH | 2 | .034 |
| $MeCl_2$ + 5.0% EtOH | 1 | .012 |
| $MeCl_2$ + 10% EtOH | 1 | .003 |
| Feed Analysis | 183 | .449 |
| $MeCl_2$ + 2% EtOH[1] + .5% $H_2O$ | 1 | .022 |
| $MeCl_2$ + 2% EtOH + 1% $H_2O$ | .5 | .118 |
| Feed Analysis | 207 | .494 |
| $MeCl_2$ | 152 | .045 |
| $MeCl_2$ + .52% MeOH[1] | 63 | .052 |
| $MeCl_2$ + 2.1% MeOH | .6 | .016 |
| $MeCl_2$ + 2% MeOH + .32% $H_2O$ | .5 | .011 |
| $MeCl_2$ + 5.2% MeOH | .5 | .012 |
| Feed Analysis | 195 | .456 |
| $MeCl_2$ | 139 | .030 |
| $MeCl_2$ + .5% DMSO[1] | 147 | .033 |
| $MeCl_2$ + 2% DMSO | 139 | .006 |
| $MeCl_2$ + 2% DMSO, $H_2O$ sat. | 2 | .018 |
| $MeCl_2$ + 5% DMSO | 2 | .006 |
| Feed Analysis | 213 | .422 |
| $MeCl_2$ | 122 | .067 |
| $MeCl_2$ + .05% ISOH[1] | 131 | .056 |
| $MeCl_2$ + 2% ISOH | 118 | .037 |
| $MeCl_2$ + 2% ISOH, $H_2O$ Sat. | 3 | .035 |
| $MeCl_2$ + 5% ISOH | 158 | .015 |

[1]EtOH = 95% ethyl alcohol 5% water; MeOH methyl alcohol; DMSO = dimethylsulfoxide; ISOH = isopropyl alcohol.

EXAMPLE 5

Toxin contaminated cottonseed meals were cracked in a flaking mill. For conditioning, twelve percent moisture was added and the meals were cooked to 180° F. After cooking and flaking to 0.008–0.012 inches, final moisture content was 10% by weight. Conditioned Cottonseed flakes were extracted in a pilot scale, Crown Iron works shallow bed percolation extractor. Solvent to flake ratio was 2:1 by weight and extraction was at room temperature. Extracted cottonseed flakes were desolventized in a conventional pilot scale desolventizer. Results reported below are the desolventized meals on an as-is basis.

| Solvent | Aflatoxin $B_1 + B_2$ (ppb by wt) | Free Gossypol (% wt) | Oil (% wt) |
|---|---|---|---|
| $MeCl_2$ | 61 | 0.135 | 1.19 |
| $MeCl_2$ + 5% EtOH | 26 | 0.056 | 0.65 |

-continued

| Solvent | Aflatoxin $B_1 + B_2$ (ppb by wt) | Free Gossypol (% wt) | Oil (% wt) |
|---|---|---|---|
| Feed Flake Analysis | 262 | 0.694 | 28.0 |

We claim:

1. A method for simultaneous toxin (gossypol and aflatoxin) and oil removal from cottonseed meal which comprises contacting the cottonseed with a solvent mixture of from 80 to 99.5 percent by weight of a chlorinated hydrocarbon solvent having one to two carbon atoms and at least one chlorine atom and from about 20 to about 0.5 percent by weight of at least one other solvent selected from the group consisting of a $C_1$ to $C_4$ alcohols, acetone, ethyl ether, dimethyl formamide, dimethyl sulfoxide, which other solvent may be saturated with water, at a temperature from room temperature to the boiling point of the solvents.

2. The process of claim 1 wherein said contacting is in a countercurrent manner with respect to movement of said cottonseed.

3. The process of claim 1 wherein said contacting is by percolation of solvent mixture through a bed of said cottonseed.

4. The process of claim 3 wherein said percolation is carried out in a series of percolation zones and said solvent moves from one zone to the next in a counter current manner.

5. The process of claim 1 wherein said cottonseed is mildly agitated during said contacting.

6. The method of claim 1 wherein said cottonseed is subjected to repeated contact with agitation to said solvent mixture.

7. The method of claim 1 wherein the cottonseed is flaked, ground or expanded prior to contact with the solvent mixture.

8. The method of claim 1 wherein said solvent mixture is from 0.5 to about 20 percent by weight of methanol based on the chlorinated solvent.

9. The method of claim 1 wherein said solvent mixture is from 0.5 to about 20 percent by weight of ethanol based on the chlorinated solvent.

10. The method of claim 1 wherein said solvent mixture is from 0.5 to about 20 percent by weight of dimethyl formamide based on the chlorinated solvent.

11. The method of claim 1 wherein said solvent mixture is from 0.5 to about 20 percent by weight of dimethyl sulfoxide based on the chlorinated solvent.

12. The method of claim 1 wherein said solvent mixture is from 0.5 to about 20 percent by weight of isopropyl alcohol based on the chlorinated solvent.

* * * * *